US010190371B2

(12) United States Patent
McWatters et al.

(10) Patent No.: US 10,190,371 B2
(45) Date of Patent: Jan. 29, 2019

(54) SUCKER ROD

(71) Applicant: Sigma Lift Solutions, Corp., Vancouver, WA (US)

(72) Inventors: Ashley McWatters, Vancouver, WA (US); Cory Church, Vancouver, WA (US)

(73) Assignee: Sigma Lift Solutions, Corp., Vancouver, WA (US)

( * ) Notice: Subject to any disclaimer, the term of this patent is extended or adjusted under 35 U.S.C. 154(b) by 397 days.

(21) Appl. No.: 14/973,199

(22) Filed: Dec. 17, 2015

(65) Prior Publication Data

US 2017/0175458 A1 Jun. 22, 2017

(51) Int. Cl.

| | |
|---|---|
| ***E21B 17/042*** | (2006.01) |
| ***E21B 17/00*** | (2006.01) |
| ***E21B 43/12*** | (2006.01) |

(52) U.S. Cl.

CPC ..... *E21B 17/00* (2013.01); *E21B 17/042* (2013.01); *E21B 43/127* (2013.01)

(58) Field of Classification Search

CPC ..... E21B 17/04; E21B 17/042; F16B 7/02; Y10T 403/635; Y10T 403/7047; Y10T 403/7051; Y10T 403/7052; Y10T 403/7058

See application file for complete search history.

(56) References Cited

U.S. PATENT DOCUMENTS

| | | | | |
|---|---|---|---|---|
| 1,455,971 | A * | 5/1923 | Rickenbacker | E21B 17/042 175/325.2 |
| 3,201,158 | A * | 8/1965 | Meripol | E21B 17/042 138/89 |
| 4,127,741 | A | 11/1978 | Bauer | |
| 4,297,787 | A | 11/1981 | Fischer | |
| 4,360,288 | A | 11/1982 | Rutledge, Jr. et al. | |
| 4,367,053 | A * | 1/1983 | Stratienko | F16D 1/094 403/371 |
| 4,401,396 | A | 8/1983 | McKay | |
| 4,430,018 | A | 2/1984 | Fischer | |
| 4,433,933 | A | 2/1984 | Parsons, Jr. et al. | |
| 4,475,839 | A | 10/1984 | Strandberg | |
| 4,494,890 | A | 1/1985 | Lusk | |
| 4,585,368 | A | 4/1986 | Pagan | |
| 4,589,796 | A | 5/1986 | Newling | |
| 4,597,688 | A | 7/1986 | Pagan | |
| 4,653,953 | A | 3/1987 | Anderson et al. | |
| 4,662,774 | A | 5/1987 | Morrow | |
| 4,787,771 | A | 11/1988 | Allen | |
| RE32,865 | E | 2/1989 | Rutledge, Jr. et al. | |
| 4,822,201 | A | 4/1989 | Iwasaki et al. | |
| 4,830,409 | A | 5/1989 | Freeman | |
| 4,919,560 | A | 4/1990 | Rutledge, Jr. et al. | |
| 4,989,902 | A | 2/1991 | Putch | |
| 5,000,611 | A | 3/1991 | Reinhart | |
| 5,253,946 | A | 10/1993 | Watkins | |

(Continued)

*Primary Examiner* — Jonathan P Masinick

(74) *Attorney, Agent, or Firm* — Chernoff Vilhauer, LLP

(57) ABSTRACT

A sucker rod includes end fittings comprising a frustoconical insert which is threaded onto a threaded rod and a sleeve with a frustoconical internal surface which encircles the insert. Tension on the end fittings wedge the frustoconical insert in the sleeve. A connector having threads for engaging an end fitting of a second sucker rod is screwed into the sleeve.

21 Claims, 5 Drawing Sheets

(56) References Cited

U.S. PATENT DOCUMENTS

| | | | | |
|---|---|---|---|---|
| 5,308,184 | A | 5/1994 | Bernard | |
| 6,193,431 | B1 | 2/2001 | Rutledge | |
| 7,648,179 | B2 * | 1/2010 | Webb | E21B 17/04 166/242.6 |
| 7,878,730 | B2 | 2/2011 | Weaver | |
| 7,972,463 | B2 | 7/2011 | Rutledge, Sr. | |
| 8,062,463 | B2 | 11/2011 | Rutledge, Sr. et al. | |
| 8,834,059 | B2 | 9/2014 | Watkins | |
| 8,851,162 | B2 | 10/2014 | Rutledge et al. | |
| 9,045,951 | B2 | 6/2015 | Rutledge et al. | |
| 9,181,757 | B2 | 11/2015 | Rutledge et al. | |
| 2014/0102715 | A1 | 4/2014 | Rutledge et al. | |

* cited by examiner

SUCKER ROD

CROSS-REFERENCE TO RELATED APPLICATIONS

Not applicable.

BACKGROUND OF THE INVENTION

The present invention relates to a sucker rod for a well pump and to a method and apparatus for attaching an end fitting to a sucker rod.

During production of a well, such as an oil well, the pressure from the reservoir may become insufficient to force the fluid to the surface. If so, a pump attached to the end of a sucker rod string may be lowered into the well. The upper end of the sucker rod string is typically attached to a pump jack or similar apparatus on the surface. The pump jack reciprocates the sucker rod string to alternately raise and lower a piston in the barrel of the pump which is submerged in the fluid in the well. When the piston is raised in the barrel by the sucker rod string, a check valve in the piston closes preventing fluid above piston from flowing back into the barrel and the lowering pressure in the barrel opens a check valve in the barrel allowing fluid in the well to flow into the barrel. When the piston is lowered in the barrel by reciprocation of the sucker rod string, the check valve in the barrel closes trapping fluid in the barrel and the check valve in the piston opens enabling the piston to move downward in the barrel causing fluid in the barrel to flow past the piston where it will be trapped when the piston is raised on the next upstroke thereby raising the level of fluid in the well.

Steel sucker rods, typically about twenty five (25) feet in length and threaded at each end, have been joined end-to-end to make up sucker rod strings. However, steel is heavy and powerful equipment is required to reciprocate a steel sucker rod string. In addition, steel is subject to corrosion in the environment of a well and repair or replacement of failed steel sucker rod strings is expensive and difficult.

Fiberglass sucker rods were introduced in the 1970's. A fiberglass sucker rod comprises a fiberglass rod and an end fitting affixed to each end of the rod. Fiberglass sucker rods are typically 37.5 feet in length although 25 and 30 foot lengths and custom lengths are available. A fiberglass sucker rod weighs approximately one-third of the weight of an equal sized steel sucker rod making transportation, handling and installation significantly easier and less expensive and reducing the cost of the pump jack and the power necessary to reciprocate the sucker rod string.

The fiberglass rod, commonly available in diameters ranging from 0.625 inches to 1.25 inches, comprises long parallel strands of glass fiber in a plastic matrix. The fiberglass rod is typically formed by the pultrusion process where glass fiber is fed through a carding plate and then impregnated with a thermosetting resin such as vinyl ester, isothalic polyester or epoxy and preheated with a radio frequency preheater. The impregnated fiber is then pulled through a heated die which forms the final shape and size of the rod and cures the thermosetting resin.

The end fittings of a fiberglass sucker rod are typically made of steel and have external shapes and dimensions conforming to recommendations of the American Petroleum Institute (API). A cylindrical first portion of the elongate end fitting extending longitudinally from a first end of the fitting includes a surface (called a coupler) defining a screw thread enabling joining of the sucker rod to another sucker rod when making up a sucker rod string. The two end fittings of a sucker rod may have threads of opposite gender enabling an end fitting of one rod to be threaded directly into an end fitting of a second sucker rod or the end fittings may be the same gender requiring a coupling having threads of the opposite gender to join the end fittings of the sucker rods.

A second longitudinal portion extending from the first or the threaded portion of the end fitting toward the second end of the fitting defines a square cross-section providing plural flat surfaces for engagement by a wrench enabling the application of torque to the fitting when making up the sucker rod string.

A third longitudinal portion extending from the second portion to the second end of the fitting typically has an annular cross-section with a cylindrical outer surface and an inner surface defining a rod cavity extending longitudinally in the end fitting from an aperture in the surface of the second end of the fitting. The rod cavity is typically circular in cross-section with a diameter which varies along the longitudinal axis of the fitting to define one or more substantially frustoconical cavity portions arrayed end-to-end along the longitudinal axis of the fitting with the larger diameter of the frustrum most remote from the second end of the fitting.

Typically, the end fittings are attached to the fiberglass rod with a thermosetting adhesive which adheres to the fiberglass rod and which hardens to form a wedge(s) in the frustoconical portion(s) of the rod cavity. To prevent the adhesive from adhering to the steel end fitting, the surface of the rod cavity is coated with a release agent which is cured. The adhesive resin, such as epoxy, is added to the rod cavity and the fiberglass rod is inserted into the cavity. Typically, the resin is cured by heating the sucker rod assembly for approximately one hour. After the adhesive resin has cured, tension is applied to the rod to set the adhesive wedges in the steel fitting. Since the adhesive resin is not adhered to the end fitting, the fitting is restrained to the rod by the bond between the adhesive and the rod and the physical interference between the wedge(s) of cured adhesive and the corresponding frustoconical surface portion(s) of the rod cavity.

As the sucker rod string is reciprocated, cyclic tension and other forces may be exerted on the sucker rod. As a result of the angular orientation of the conical surface of the adhesive wedge to the longitudinal axis of the fiberglass rod, a component of the tension force on the sucker rod is exerted normal to the longitudinal axis of the fiberglass rod radially compressing the rod. In addition, the cyclic nature of the forces exerted on the sucker rod is believed to cause creep in the adhesive wedge further radially compressing the fiberglass rod near the intersection of the rod and the smaller diameter end of the conical wedge. Although the exact nature of the failure mode is unknown, fiberglass sucker rods commonly fail proximate the point at which the rod meets the end fitting where the radial compression of the rod is expected to be greatest. Since introduction of fiberglass sucker rods there have been continued efforts to improve the sucker rod with much of the effort directed to the relationship of the steel end fittings and the fiberglass rod and in particular to changing the shape of the interface between the cured adhesive, the fiberglass rod and the end fitting.

What is desired, therefore, is a fiberglass sucker rod assembly which is stronger, has improved life and more consistent performance.

DETAILED DESCRIPTION OF PREFERRED EMBODIMENTS

Figure 1:
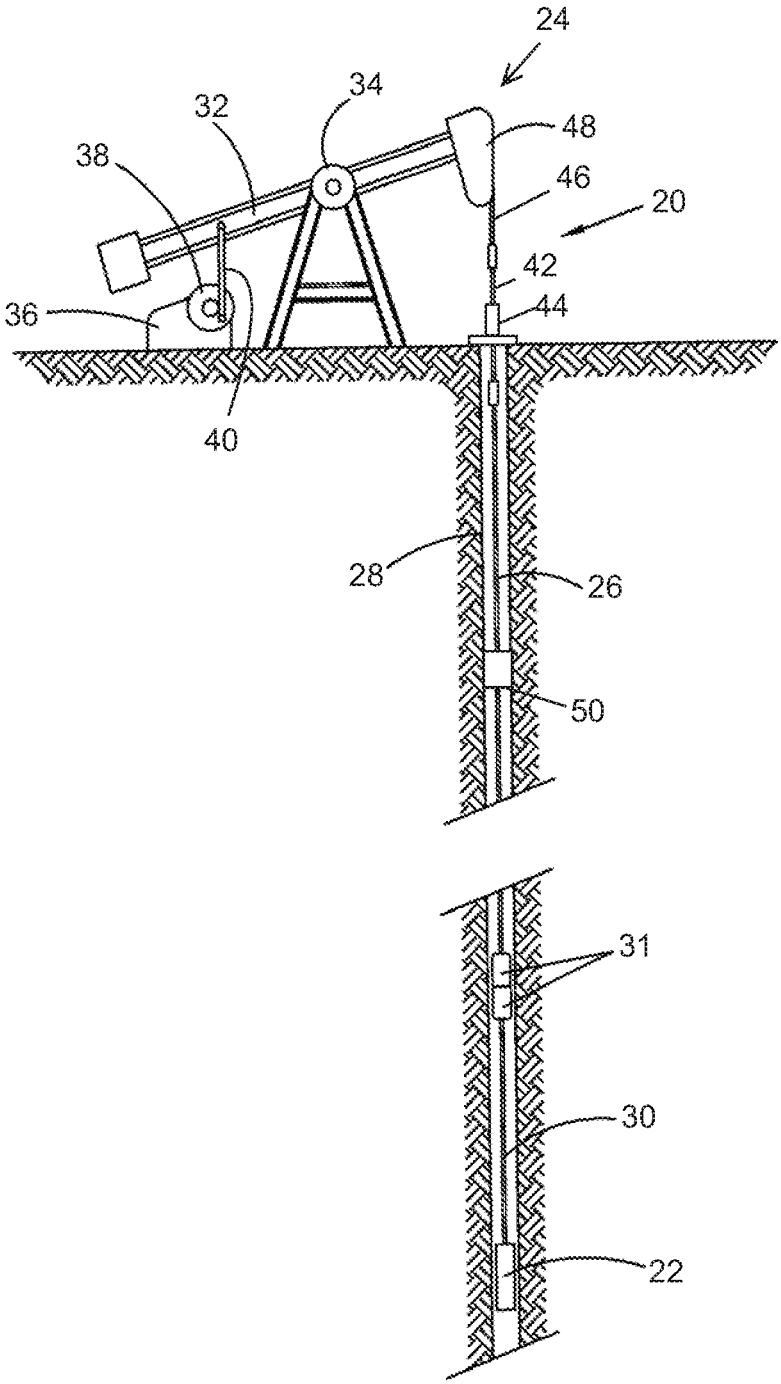
FIG. 1 is a cutaway pictorial of a well pumping system.

Referring in detail to the drawings where similar parts are identified by like reference numerals, and, more particularly to FIG. 1 a well pumping system 20 comprises generally a down-hole pump 22 which is connected to a pump drive system or pump jack 24 at the surface by a sucker rod string 26 which is extends down a tubing lined wellbore 28. The exemplary pump drive system 20 comprises a walking beam 32 which is pivotally mounted on a Sampson post 34. The walking beam is pivoted on the Sampson post by a power unit 36 including a motor and a gearbox which rotates a crank 38 connected to the walking beam by a crank pin link 40. The sucker rod string 26 is typically connected to a polished rod 42 that passes through seals in a stuffing box 44 at the surface. The polished rod is connected to a horsehead 48 by a bridle 46 which converts the arcing motion at the end of the walking beam to a substantially vertical reciprocating motion. The sucker rod string 26 comprises multiple sucker rods 30 which are connected together end-to-end. End fittings 31 of the sucker rods 30 terminate in screw threads enabling plural sucker rods to be connected when making up the sucker rod string 26. The screw threads at the respective ends of the sucker rod may be of opposite gender enabling a sucker rod string to be assembled by threading the end fitting 31 of one sucker rod directly into the end fitting 31 of the next rod or both end fittings may have screw threads of the same gender enabling joining of adjacent sucker rod assemblies with a coupler having screw threads of the opposite gender. Since wells are commonly not straight, sucker rod guides 50 or centering accessories may be attached to the sucker rods of the sucker rod string to center the rods in the well casing, the tubing which lines the wellbore 28, and protect the sucker rods and the well casing from abrasion by the reciprocating sucker rod string.

A fiberglass sucker rod typically comprises a fiberglass rod having a diameter between 0.625 inches and 1.25 inches with a steel end fitting affixed to each end of the fiberglass rod. Assembled fiberglass sucker rods are typically 37.5 feet in length, although 25 and 30 foot sucker rods and custom length sucker rods are available. The steel end fittings are typically secured to the fiberglass rod by a thermosetting resin adhesive, such as epoxy. The end fitting includes a rod cavity that extends longitudinally in the fitting from the second end of the fitting, that is, the end of the fitting opposite of the threaded end. The rod cavity is typically circular in cross-section with a diameter that varies to define one or more frustoconical cavity portions spaced along the longitudinal axis of the fitting with the smaller end(s) of the frustrum(s) proximate the second end of the fitting. To avoid adherence of the adhesive resin to the steel end fitting, the surface of the rod cavity is coated with a release agent which is cured. The resin adhesive is added to the rod cavity and the fiberglass rod inserted into cavity. The rod assembly is heated for at least an hour to cure the adhesive which forms a rigid mass adhering to the fiberglass rod and conforming to the inner surface of the rod cavity. Adherence of the cured adhesive to the rod and physical interference between the frustoconical portion(s) of the cured adhesive and the rod cavity secures the end fitting to the rod.

Fiberglass sucker rods commonly fail near the point where the fiberglass rod projects from the end fitting. The precise cause of failure is not known but is believed to be related to radial compression of the fiberglass rod which is greatest near where the rod projects from the fitting. As a result of the angular orientation of the outer surface of the adhesive mass relative to the longitudinal axis of the fiberglass rod, tensile forces applied to the sucker rod produce a radially compressive force on the fiberglass rod. In addition, the cyclic force applied to the reciprocating sucker road may cause creep in the plastic adhesive mass forcing the plastic between the rod and the wall of the rod cavity and increasing the radial compression of the rod at a point near where the rod exits the end fitting. Since fiberglass sucker rods were first introduced, efforts have been made to improve the strength and life of the sucker rods usually by changes in the shape and/or size of the rod cavity and the corresponding wedge of adhesive. The inventors concluded that substantial improvements in the strength, life and utility of fiberglass sucker rod assemblies would be possible by changing the mechanism used to secure the end fittings to the fiberglass rod.

Figure 2:
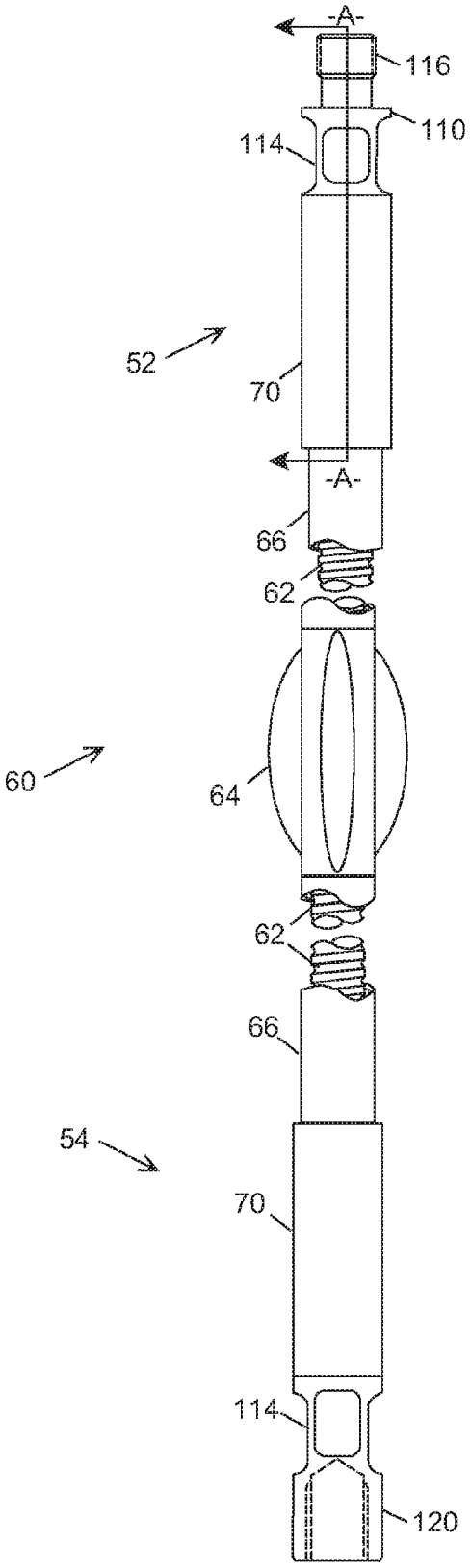
FIG. 2 is an elevation view of an exemplary sucker rod.
Figure 3:
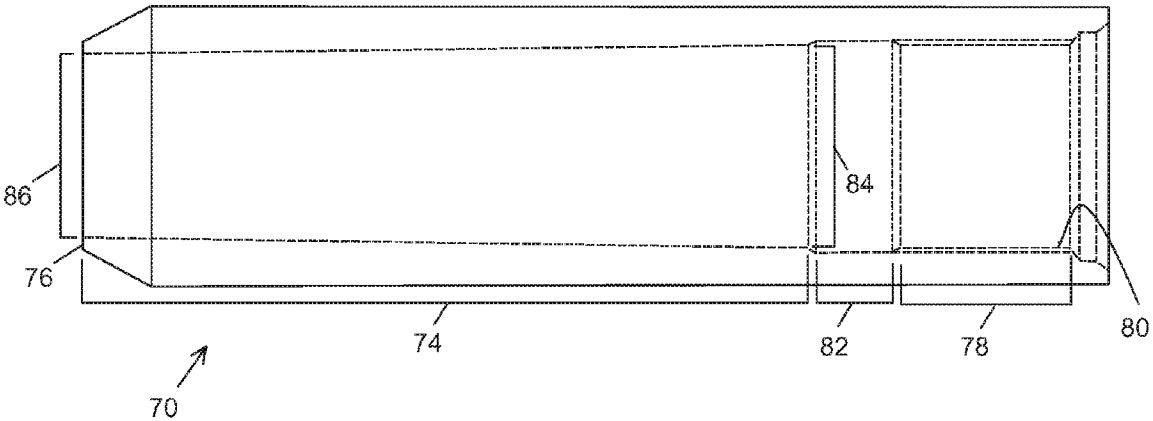
FIG. 3 is an elevation view of a sleeve for a sucker rod end fitting.
Figure 4:
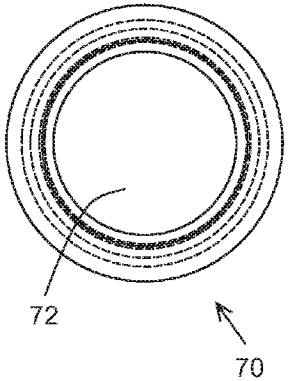
FIG. 4 is an end view of the sleeve of FIG. 3.
Figure 5:
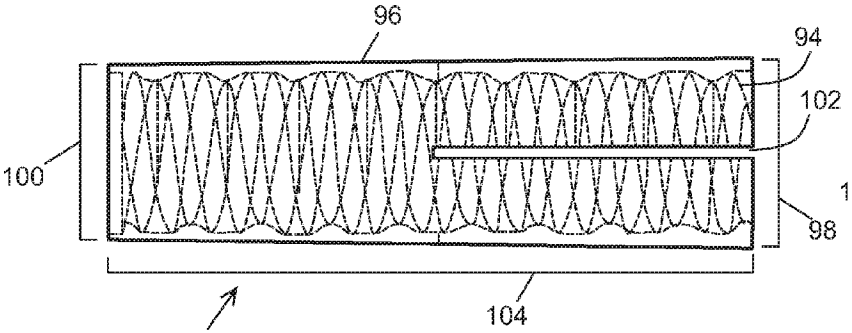
FIG. 5 is an elevation view of an insert for a sucker rod end fitting.
Figure 6:
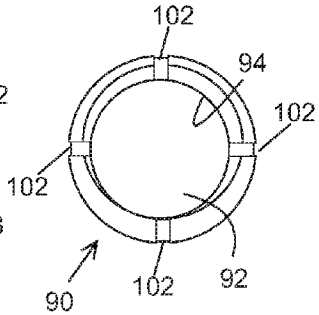
FIG. 6 is an end view of the insert of FIG. 5.
Figure 7:
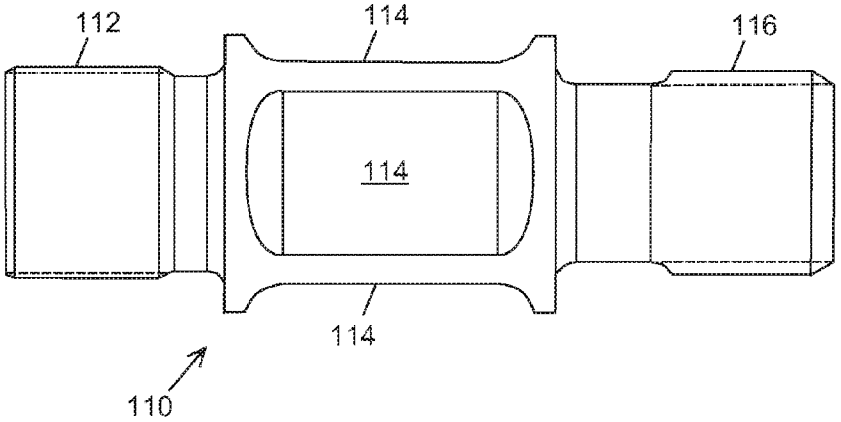
FIG. 7 is an elevation view of a first connector for a sucker rod end fitting.
Figure 8:
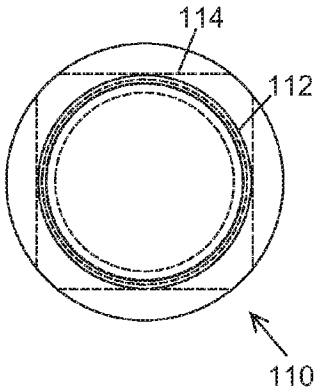
FIG. 8 is an end view of the first connector of FIG. 7.
Figure 9:
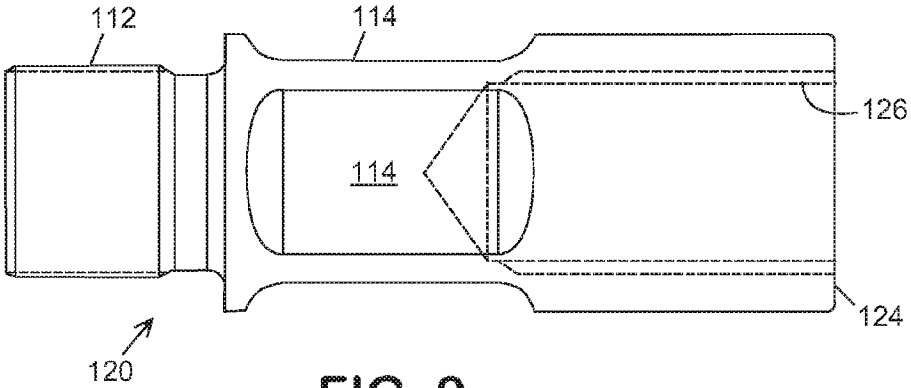
FIG. 9 is an elevation view of a second connector for a sucker rod end fitting.
Figure 10:
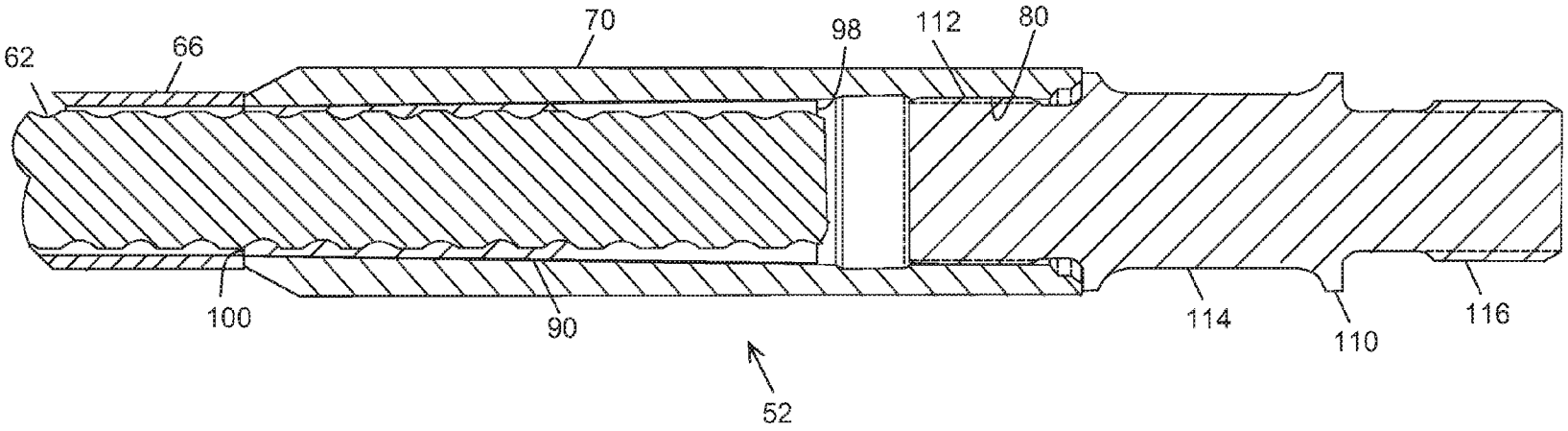
FIG. 10 is a partial section view of the sucker rod of FIG. 2 taken along line A-A.

Referring also to FIG. 2 an exemplary sucker rod 60 of new construction includes a threaded fiberglass rod 62 having an end fitting 52, 54 affixed to the respective ends of the rod. Although it is sufficient for assembly of the sucker rod 60 to provide threads on only the portions of the fiberglass rod 62 which engage the end fittings 52, 54, preferably the threads are defined along the entire length of the fiberglass rod. Continuing the threads for the length of the fiberglass rod 62 reduces any concentration of stress resulting from a discontinuity at the juncture of the threaded and unthreaded portions of the rod. In addition, with threads defined along the full length of the rod, sucker rod guides 64 and other sucker rod accessories with an internal thread can be located at any desired position on the fiberglass rod by either threading the sucker rod guide or other accessory onto the rod or by joining together on the rod the portions of a split rod guide or accessory with a thread engaging internal surface. To prevent the rod from contacting the well casing which is typically not straight and abrading the casing or the rod, one or more sucker rod guides 64 are commonly installed on the rod to center the rod in the casing.

Preferably, the fiberglass sucker rod 60 also includes a tubular plastic sheath 66 which encircles the rod. The sheath 66 provides additional abrasion protection for the rod and the well bore casing and, in the event a rod should break, the sheath will contain any fiberglass fragments reducing well contamination and clean up. In addition, the positions on the rod 62 of threaded rod guides 64 and/or other accessories can be maintained by installing portions of the sheath 66 which abut the rod guide or accessory and adjacent end fittings, rod guides or accessories.

Referring also to FIGS. 3-10, each end fitting 52, 54 of the exemplary sucker rod assembly 60 comprises generally a sleeve 70, an insert 90 and one of plural connector portions 110, 120. The sleeve 70 may comprise an elongate tubular cylinder defining a longitudinal internal aperture 72. The internal aperture 72 of the sleeve 70 defines a first portion 74

(indicated by a bracket) extending longitudinally from a first end 76 of the sleeve and second portion 78 (indicated by a bracket) having a surface defining a screw thread 80. Extending longitudinally from the end of the first portion 74 of the aperture 72 to the threaded second portion 78 may be a third portion 82 (indicated by a bracket) providing a relief to accommodate the thread cutting tool used to generate the threads 80 on the surface of the second portion of the aperture 72. The surface of the first portion 74 of the aperture 72 in the sleeve defines a frustrum of a cone with a larger end 84 (indicated by a bracket) or major dimension distal of the first end 76 of the sleeve 80 and a smaller end 86 (indicated by a bracket) or minor dimension proximate the first end of the sleeve.

The insert 90 comprises an elongate tubular element defining an aperture 92 extending longitudinally through the insert. The surface of the aperture 92 defines a screw thread 94 arranged for engagement with the thread defined on the external surface of the fiberglass rod 62. The external surface 96 of the insert 90 defines a frustum of a cone. Preferably, the larger end 98 (indicated by a bracket) or major dimension of the frustoconical exterior surface of the insert 90 is larger than the larger end 84 of the frustoconical first portion 74 of the aperture 72 in the sleeve 70 and the smaller end 100 or minor dimension of the frustoconical exterior surface of the insert is smaller than the smaller end 86 of the frustoconical portion of the interior surface of the sleeve. In other words, the slope of the frustoconical exterior surface 96 of the insert 90 is greater than the slope of the frustoconical portion 74 of the aperture surface of the sleeve 70. The insert 90 further defines plural longitudinal slots 102 connecting the exterior surface 96 and the surface of the aperture 92 and extending from the end of the insert proximate the larger end 98 of the conical exterior surface. To maximize the strength of the end fitting, preferably, the length of the longitudinal slots 102 is less than one-half the length 104 of the insert (indicated by a bracket).

To facilitate interconnecting sucker rods in making up a sucker rod string, the end fittings 52 and 54 of the exemplary sucker rod 60 preferably include portions conforming to the recommendations of the American Petroleum Industry (API). Each end fitting 52, 54 comprises a connector 110, 120 including a portion extending longitudinally from a first end of the connection and defining a first screw thread 112 arranged to engage the screw threads 80 of the threaded portion 78 of the sleeve 70. A second axial portion of the connectors 110, 120 preferably has a square cross-section, preferably conforming to the API recommendations, defining plural wrench flats 114. The wrench flats 114 facilitate the application of torque to the connector when threading the connector into the sleeve 70 and when connecting the sucker rod 60 to a second sucker rod to make up a sucker rod string. The connector 110 includes a third axial portion or coupler comprising a surface defining a second external screw thread 116. The second screw thread 116 preferably conforms to the API recommendations and enables coupling of the exemplary sucker rod 62 to the end of another sucker rod having a thread of opposite gender, such as the connector 120. The connector 120 defines an aperture extending axially from the second end 124 of the connector with a surface defining an internal thread 126 enabling the exemplary sucker rod 60 to be connected to another sucker rod having screw threads conforming to the second external threads 116 of connector 110. While the respective end fittings 52, 54 of the exemplary sucker rod 60 have coupler threads 116, 126 of opposite gender enabling sucker rod assemblies to be connected by directly threading together the end fittings on two sucker rods; some sucker rods have end fittings with threads of the same gender on both ends of the rod. In this case, adjacent sucker rods are typically joined together with a coupler having threads of the opposite gender to those of the end fittings.

The end fittings 52, 54 of the exemplary sucker rod 60 are assembled by inserting the rod 62 into the first end 76 of the aperture 72 in the sleeve 70. With the smaller end 100 of the frustoconical exterior surface 96 nearest the midpoint of the rod 62, the insert 90 is threaded onto the rod. Assembly is completed by threading one of the connectors 110 or 120 into the sleeve 70 at each end of the rod 62. Tension on the sucker rod 60 urges the frustoconical surface of the insert 90 to wedge in the frustoconical portion 74 of the aperture 72 in the sleeve 70. As the insert 90 is urged into the sleeve 70, the longitudinal slots 102 in the insert enable controlled radial loading of the rod by the insert increasing friction between the insert and the rod to resist rotation.

The detailed description, above, sets forth numerous specific details to provide a thorough understanding of the present invention. However, those skilled in the art will appreciate that the present invention may be practiced without these specific details. In other instances, well known methods, procedures, components, and circuitry have not been described in detail to avoid obscuring the present invention.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

We claim:

1. A sucker rod comprising:

(a) an elongate threaded fiberglass rod having an outer surface portion from which fiberglass material has been removed to define a screw thread:

(b) an elongate sleeve defining an axial cavity to receive said rod, said axial cavity having a surface defining;

i. an axially extending frustoconical first portion having a minor dimension proximate a first end of said sleeve and a major dimension axially distal of said first end of said sleeve, said rod initially received in said cavity at said first end of said sleeve; and ii. a threaded portion proximate a second end of said sleeve;

(c) an elongate threaded insert having a frustoconical outer surface with a minor dimension and a major dimension, said outer surface of said insert in wedged engagement with said frustoconical portion of said axial cavity of said sleeve, said insert defining an axial cavity having a cavity surface defining a screw thread in threaded engagement with said screw thread of said rod; and (d) a connector having a surface defining a first threaded portion extending axially proximate a first end of said connector and a second threaded portion extending axially proximate a second end of said connector, said first threaded portion in threaded engagement with said threaded portion of said sleeve.

2. The sucker rod of claim 1 wherein said second threaded portion of said connector comprises a screw thread defined on an exterior surface of said connector.

3. The sucker rod of claim 1 wherein said second threaded portion of said connector comprises a screw thread defined on a surface of an axial aperture defined by said connector.

4. The sucker rod of claim 1 wherein said major dimension of said frustoconical surface of said insert is greater than said major dimension of said frustoconical first portion of said sleeve and said minor dimension of said frustoconical surface of said insert is less than said minor dimension of said first portion of sleeve.

5. The sucker rod of claim 1 wherein said major dimension, said minor dimension and a length of said frustoconical outer surface of said insert defines a slope of said frustoconical outer surface of said insert and said major dimension, said minor dimension and a length of said frustoconical first portion of said sleeve defines a slope of said frustoconical first portion of said sleeve, said slope frustoconical outer surface of said insert exceeding said slope of said frustoconical first portion of said sleeve.

6. The sucker rod of claim 1 wherein said threaded portion of said insert further defines an axial slot connecting said outer surface and said cavity surface.

7. The sucker rod of claim 6 wherein a length of said slot is less than one-half of a length of said insert.

8. The sucker rod of claim 1 further comprising a sheath encircling a portion of said rod and abutting at least one of said sleeve and said insert.

9. The sucker rod of claim 1 wherein said engagement of said threaded insert and said threaded fiberglass rod is free of adhesive.

10. The sucker rod of claim 1 wherein said threaded fiberglass rod has a length and said screw threads are defined along said length of said rod.

11. A sucker rod end fitting comprising:

(a) an elongate sleeve defining an axial cavity to receive a threaded fiberglass rod, said axial cavity having a surface defining:
   i. an axially extending frustoconical first portion having a minor dimension proximate a first end of said sleeve and a major dimension axially distal of said first end of said sleeve; and
   ii. a threaded portion proximate a second end of said sleeve;

(b) an elongate threaded insert having a frustoconical outer surface with a minor dimension and a major dimension, said outer surface of said insert arranged for wedging engagement in said frustoconical portion of said axial cavity of said sleeve, said insert defining an axial cavity having a cavity surface defining a screw thread arranged for threaded engagement with a screw thread of said threaded fiberglass rod; and (c) a connector having a surface defining a first threaded portion extending axially proximate a first end of said connector and a second threaded portion extending axially proximate a second end of said connector, said first threaded portion arranged for threaded engagement with said threaded portion of said sleeve.

12. The sucker rod end fitting of claim 11 wherein said second threaded portion of said connector comprises a screw thread defined on an exterior surface of said connector.

13. The sucker rod end fitting of claim 11 wherein said second threaded portion of said connector comprises a screw thread defined on a surface of an axial aperture defined by said connector.

14. The sucker rod end fitting of claim 11 wherein said major dimension of said frustoconical surface of said insert is greater than said major dimension of said frustoconical first portion of said sleeve and said minor dimension of said frustoconical surface of said insert is less than said minor dimension of said first portion of sleeve.

15. The sucker rod end fitting of claim 11 wherein said major dimension, said minor dimension and a length of said frustoconical outer surface of said insert defines a slope of said frustoconical outer surface of said insert and said major dimension, said minor dimension and a length of said frustoconical first portion of said sleeve defines a slope of said frustoconical first portion of said sleeve, said slope of said frustoconical outer surface of said insert exceeding said slope of said frustoconical first portion of said sleeve.

16. The sucker rod end fitting of claim 11 wherein said threaded insert further defines an axial slot connecting said outer surface and said threaded cavity surface.

17. The sucker rod end fitting of claim 16 wherein a length of said slot is less than one-half of a length of said insert.

18. A method for assembling a sucker rod, the method comprising the steps of:

(a) inserting an elongate threaded fiberglass rod having an outer surface defining a screw thread into an axial cavity defined by an elongate sleeve, the cavity having:
   i. an axially extending frustoconical first portion having a minor dimension proximate a first end of said sleeve and a major diameter distal of said first end of said sleeve, said rod initially received in said cavity at said first end of said sleeve; and
   ii. a threaded portion proximate a second end of said sleeve;

(b) threading an insert on said rod, said insert defining an axial cavity having a surface defining a screw thread mating engageable with said screw thread of said fiberglass rod and a frustoconical outer surface arranged for wedged engagement with said frustoconical portion of said cavity defined by said sleeve;

(c) sliding said sleeve into wedging engagement with said frustoconical portion of said insert; and (d) threading a first portion of a connector into engagement with said sleeve, said first portion of said connector defining a screw thread arranged for threaded engagement with said threaded portion of said sleeve, said connector having another surface defining another screw thread.

19. The method for assembling a sucker rod of claim 18 wherein said another screw thread of said connector is defined on an exterior surface of said connector.

20. The method for assembling a sucker rod of claim 18 wherein said another screw thread of said connector is defined on a surface of an axial aperture defined by said connector.

21. The method of assembling a sucker rod of claim 18 wherein said method does not include the use of an adhesive between said threaded fiberglass rod and said insert.

* * * * *